United States Patent [19]

Breslin

[11] Patent Number: 4,598,182

[45] Date of Patent: Jul. 1, 1986

[54] LOCK INHIBITOR FOR TOGGLE SWITCH ACTUATOR

[76] Inventor: Daniel V. Breslin, 7934 Ridge Ave., Philadelphia, Pa. 19128

[21] Appl. No.: 596,600

[22] Filed: Apr. 4, 1984

[51] Int. Cl.[4] ..... H01H 9/28

[52] U.S. Cl. ..... 200/43.11; 200/50 R

[58] Field of Search ..... 200/43.01–43.22, 200/339, 50 A, 50 B, 323, 50 R

[56] References Cited

U.S. PATENT DOCUMENTS

| | | | |
|---|---|---|---|
| 1,730,683 | 10/1929 | Philbrick et al. | 200/43.11 X |
| 1,798,186 | 3/1931 | Bingaman | 200/43.11 |
| 1,825,325 | 9/1931 | Millermuster et al. | 200/43.04 |
| 1,827,732 | 10/1931 | Conlan | 200/43.13 |
| 2,328,848 | 9/1943 | Russell | 200/43.11 |
| 2,771,521 | 11/1956 | Cressman et al. | 200/43.05 |
| 3,188,411 | 6/1965 | Luenser | 200/50 R |
| 3,714,383 | 1/1973 | Leonard et al. | 200/43.08 |
| 3,912,888 | 10/1975 | Takahashi | 200/43.06 |
| 4,016,379 | 4/1977 | Merkle | 200/43.11 |
| 4,107,484 | 8/1978 | Petersen | 200/43.04 |
| 4,230,917 | 10/1980 | Osika | 200/43.01 |

*Primary Examiner*—J. R. Scott

*Attorney, Agent, or Firm*—Jacob Trachtman

[57] ABSTRACT

A lockable switch for an electric cord comprising a housing, a switch having "on" and "off" positions retained within the housing and having a control operative from outside the housing for moving the switch between its "on" and "off" positions, and terminals for electrically engaging and connecting the switch with an electric cord received within and extending through the housing. A key-actuated lock having locked and unlocked conditions, and an interengagement device actuated by the lock for engaging the switch and locking the switch against movement when the lock is in its locked condition are also contained within the housing. The lock which is rotatable has a cam element provided by an extending tumbler which rotates with the actuation of the lock between its locked and unlocked conditions and actuates the interengaging device toward and away from the switch for engaging and disengaging the control and locking and unlocking the switch.

9 Claims, 5 Drawing Figures

FIG. 1
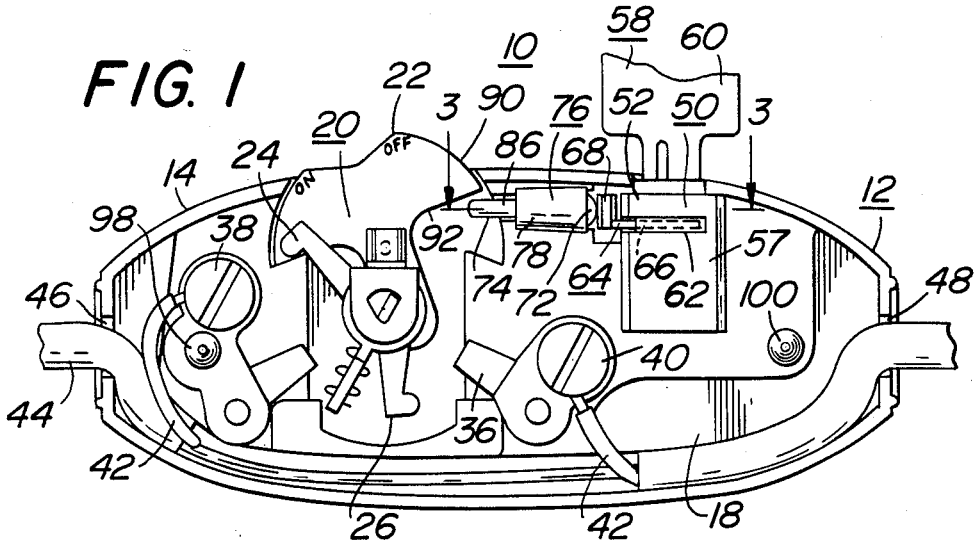
FIG. 2
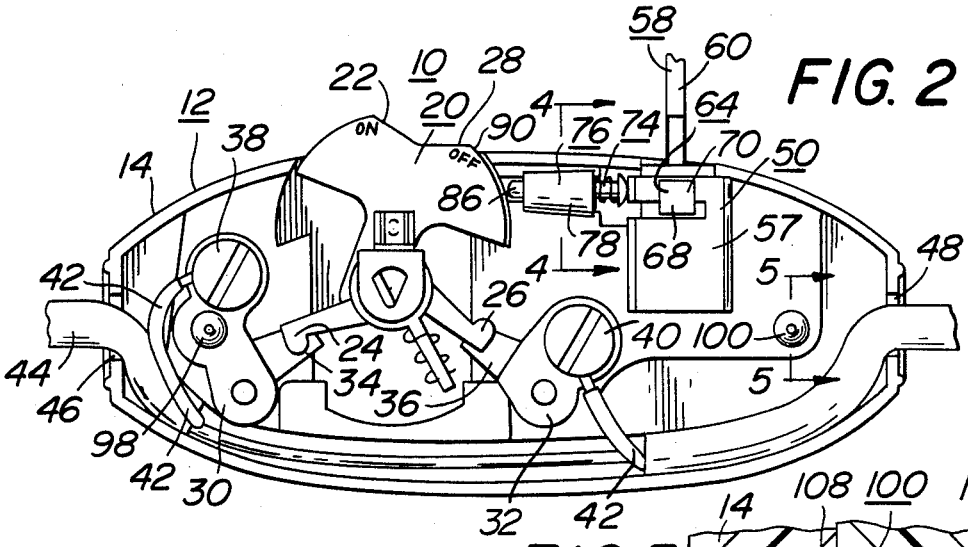
FIG. 5
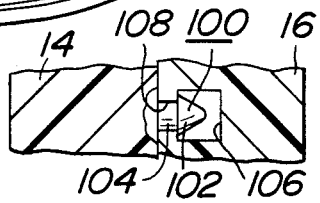
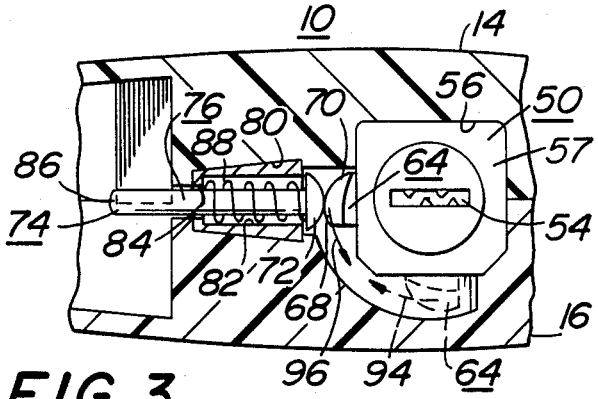
FIG. 3
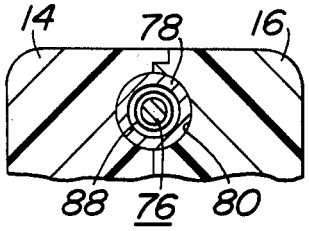
FIG. 4

LOCK INHIBITOR FOR TOGGLE SWITCH ACTUATOR

BACKGROUND OF THE INVENTION

The invention relates to a lockable switch means for an electric cord, and more particularly to a toggle type switch for an electric cord which is lockable to prevent unauthorized operation thereof.

There are many situations in which it is desired to prevent operation of certain electrical equipment by unauthorized persons. It may also be desirable to control operation at certain times and under certain conditions of such equipment or electrical accessories. It is therefore desirable to provide means by which access may be readily controlled as by use of a lockable electric switch which opens and closes a circuit including an electric cord providing energization or other control of the electrical equipment or accessories. A lockable electric switch means of this type which can be easily installed by the user as well as by the original manufacturer is also desirable.

SUMMARY OF THE INVENTION

It is therefore a principal object of the invention to provide a new and improved lockable switch for an electric cord which allows the operation of the switch to be controlled for preventing operation of the switch and the electrical equipment associated therewith by unauthorized personnel.

Another object of the invention is to provide a new and improved lockable switch means for an electric cord which may be readily installed by a user or by an original manufacturer.

Another object of the invention is to provide a new and improved lockable switch for an electric cord which may easily be installed and cannot be disassembled after such installation.

Another object of the invention is to provide a new and improved lockable switch for an electric cord which is relatively small in size, easy to operate and highly reliable.

Another object of the invention is to provide a new and improved lockable switch for an electric cord utilizing components which are readily available and can be easily assembled and inexpensively manufactured.

Another object of the invention is to provide a new and improved lockable switch for an electric cord which is durable and maintenance free.

The above objects and advantages, as well as many other advantages are achieved by providing a lockable switch for an electric cord comprising a housing having an elongated oval configuration with first and second ends each providing an opening for receiving therethrough an electric cord which is to have its circuit opened and closed. The housing has first and second mating halves which are initially disassembled for having the cord connected with terminal means of a toggle switch retained within the housing, and after connection has interlocking means for permanently securing the halves together about the electric cord. The switch has "on" and "off" positions and a control lever operated from outside the housing for moving the switch between its positions. A lock having locked and unlocked conditions is contained within the housing for being key-actuated from outside the housing. The lock actuates interengagement means for engaging the control lever of the switch and locking the switch against movement when the lock is in its locked condition, and disengaging and unlocking the switch when the lock is in its unlocked condition.

The lock is a cylinder lock which is rotatable between its locked and unlocked conditions and has a movable cam element provided by an extending tumbler element which rotates with the actuation of the lock between its locked and unlocked conditions. The interengagement means comprises a pin having a head which is engageable by the cam element of the lock, and an end which is movable towards and away from the lever of the switch for engaging and disengaging the lever and locking and unlocking the switch. Spring means of the interengagement means urges the head of the pin towards and into contact with the surface of the cam. When the switch is in its "off" position and the lock is in its locked condition, the pin of the interengagement means prevents movement of the control lever to its "on" condition.

BRIEF DESCRIPTION OF THE DRAWING

The foregoing and other objects of the invention will become more apparent as the following detailed description of the invention is read in conjunction with the drawing, in which:

FIG. 1 is a plan view of a lockable switch for an electric cord embodying the invention showing one half of its housing containing an electrical toggle switch, terminals, a lock and interengagement means, FIG. 2 is a view similar to that of FIG. 1, except that the toggle switch is in its "on" position and the locking means is in its "off" condition to show the interengaging means disengaged from the lever of the toggle switch, FIG. 3 is a sectional view on the line 3—3 of FIG. 1 with parts broken away, FIG. 4 is a fragmentary sectional view on the line 4—4 of the FIG. 2, and FIG. 5 is a fragmentary sectional view on line 5—5 of FIG. 2 showing the means for interlocking the halves of the housing.

Like reference numerals designate like parts throughout the several views.

DETAILED DESCRIPTION

Refer to the figures which illustrate a lockable switch 10 for an electric cord embodying the invention. The electric switch 10 comprises a housing 12 having an elongated oval configuration formed of two half portions 14, 16 preferably made of a suitable plastic material and providing a cavity 18 therein. An electric toggle switch 20 comprising a control lever 22 operating electrical contact arms 24, 26 is positioned within the cavity 18 and retained by the half portion 14 of the housing 12. The toggle switch 20 may be of convention construction in which the contact arms 24, 26 are in the "off" position when the control lever is positioned as shown in FIG. 1, and switches to its "on" position when the control lever 22 is actuated to its position shown in FIG. 2. The control lever 22 is positioned so that it has a top surface 28 for manual actuation accessible from the outside of the housing 12 for moving the switch between its "on" and "off" positions. A pair of connecting terminals 30, 32 are provided within the cavity 18 of the housing 12 secured with the half portion 14, each having an extending contact portion 34, 36 for respectively engaging the switch arms 24, 26 when the switch is in its "on" position, and screw means 38, 40 for engaging and being secured with the ends of a severed electric wire 42 of an electric cord 44. The cord 44 extends into and out of the housing 12 through the end openings 46, 48 in the housing 12 and is positioned within a channel or space provided along the bottom of the housing 12 between the openings 46, 48. The cord 44 which passes through the housing 12 of course may contain one or more other wires which are not connected with the toggle switch 20.

A lock 50 which may be of the rotatable multiple tumbler type has its housing secured within the cavity 18 with an end 52 positioned to allow access to its key way 54 from outside of the housing 12. The lock 50 is actuated between its locked and unlocked conditions by rotation of the key 58 upon insertion in the key way 54, and has a substantially rectangular shaped outer housing 57 which is received into a rectangular slot 56 in the portion 14 of the housing 12 to prevent rotation or movement when the lock is actuated. When in its locked condition shown in FIG. 1, the lock 50 has the enlarged key end 60 extending in the direction between the openings 46 and 48 of the housing 12, while when in its unlocked condition the key 58 is rotated 90°, so that its end 60 extends in a transverse direction of the housing 12 as shown in FIG. 2.

The side of the housing 57 of the lock 50 is provided with a slot 62 (FIG. 1). A cam element 64 comprising a tumbler portion 66 within the housing 57 and a cam portion 68 which extends outside of the housing 57 through the slot 62 is actuated to rotate with the movement of the lock 50 between its locked and unlocked conditions. The tumbler portion 66 of the cam element 64 is modified to have an enlarged opening so that the key 58 extends therethrough without radially displacing the cam element 64. The slot 62 through which the cam element 64 extends is sufficiently elongated to allow for a 90° rotation of the element 64 with the rotation of the lock 50 by the key between its closed and opened conditions. The cam portion 68 of the cam element 64 which is external of the housing 57 extends transversely to its tumbler portion 66 and has a contact surface 70 which is curved as shown in FIG. 3 for engaging the head 72 of a pin 74 (FIG. 1) of an interengaging means 76.

The interengaging means 76 includes a tubular housing 78 (FIG. 1) with an outer configuration which is a conical section received within a similarly shaped cavity 80 (FIG. 3) between the halves 14 and 16 of the housing 12 for retaining same in position between the lock 50 and the switch 20. The housing 78 has an inner cylindrical wall 82 providing a cavity therethrough for receiving the pin 74, and having a lip providing an opening 84 of reduced size at one end through which the end 76 of the pin 74 extends. A coiled spring 88 is received within the housing 78 about the pin 74 engaging at one end the head 72 of the pin 74 and at the other end the lip of the opening 84 for urging the pin 74 in a direction towards the lock 50. Thus, when the lock 50 is in its unlocked condition as shown in FIG. 2 with its cam portion 68 rotated away from the head 72 of the pin 74, the spring 88 actuates the pin 74 to move in a direction to the right for placing it in its disengaged condition. In this condition, as seen in FIG. 2, the control lever 22 of the toggle switch 20 may be moved between its "on" and "off" positions for making and breaking the circuit through the wire 42 of the cord 44.

When the control lever 22 is in its "on" position, its end surface 90 is positioned proximate to the end 86 of the pin 74 preventing its movement away from the lock 50 and maintaining it in its disengaged position. When the control lever 22 of the switch 20 is in its "off" position as shown in FIG. 1, its end surface 90 moves away from the end 86 of the pin 74 leaving it free for actuation away from the lock 50 and towards the undersurface 92 of the control lever 22. The rotation of the key 58 actuating the lock 50 from its unlocked condition towards its locked condition results in movement of the cam element in the clockwise direction indicated by the arrow 94 of FIG. 3. As the cam element 64 approaches the head 72 of the pin 74 its contact surface 70 moves the pin 74 to the left compressing the spring 88. This results in the displacement of the pin 74 to the left into its engaged positioned with its end 86 under the control lever 22 contacting its surface 92. This prevents movement of the control lever from its "off" position, thereby locking it against actuation into its "on" position. When the key is rotated for placing the lock 50 in its unlocked condition, the cam element 64 moves as indicated by the arrow 96 in FIG. 3, in the counter clockwise direction. This results in the cam surface 70 of the cam element 64 disengaging the head 72 of the pin 74 allowing the spring 88 to move it to the right toward its disengaged condition. This serves to unlock the switch 20 so that it may be operated between its "on" and "off" positions.

For the purpose of applying the lockable switch means 10 to a cord 44, at least one of the wires 42 of the cord which may contain a plurality of wires is severed for providing a pair of ends, each of which ends is respectively positioned under the head of a screw 38 and 40 and secured therewith. The remaining wire or wires of the cord are positioned within the housing portion 14 as shown in FIGS. 1 and 2 with the cord extending through the openings 46 and 48. The portion 14 of the housing 12 is provided with a pair of projecting portions 98, 100 each having an enlarged head 102 and reduced neck region 104 as shown in FIG. 5. The companion half portion 16 of the housing 12 is provided with complimentary cavities 106 having reduced openings 108 as also shown. After the cord 44 has been inserted and connected as described, the halves 14 and 16 of the housing 12 are proximately positioned and secured together by inserting the projections 98, 100 into the openings 106 so that the heads 102 of the projections 98, 100 extend beyond the reduced openings 108 and into the cavities 106 for permanently interlocking and preventing the disassembly of the halves 14 and 16 of the housing 12.

In the operation of the lockable switch for an electric cord, the lockable switch is applied to a power or control cord associated with equipment or auxiliary means which are to be secured against operation by unauthorized persons. When the switch 50 is placed in its "off" position, the lock 50 may be placed in the locked condition and the key removed. This prevents operation of the switch means until it is unlocked, at which time the toggle switch may be operated between its "on" and "off" positions as desired. The lockable switch, thus may readily be applied to an electric cord, is small in size and convenient to operate. The lockable switch 10 may be produced inexpensively and is reliable and durable.

Although the invention has been described with respect to a particular embodiment, it will be obvious to those skilled in the art, that the invention disclosed may be modified to meet various design requirements without substantial departure from the essence of the invention.

What is claimed is:

1. A lockable switch means for an electric cord comprising a housing, a switch having "on" and "off" positions retained within the housing and having a control means operative from outside of the housing for moving the switch between its "on" and "off" positions, a lock having locked and unlocked conditions contained within the housing for being key-actuated between locked and unlocked conditions from outside the housing, terminal means provided within the housing for electrically engaging and connecting with the switch an electrical cord received within the housing for opening and closing a circuit therethrough by actuation of the switch, and interengagement means actuated by the lock for engaging the switch and locking the switch against movement when the lock is in its locked condition and disengaging and unlocking the switch to allow it to be respectively moved between its "on" and "off" positions when the lock is retained in its unlocked condition, the switch is a toggle switch with a control lever pivotable between a first "on" position and second "off" position, and the interengagement means engages and disengages the lever for locking and unlocking the switch.

2. The switch means of claim 1 in which the lock includes a movable cam element which actuates the interengagement means for engaging and disengaging the lever of the switch.

3. The switch means of claim 2 in which the lock is a cylindrical lock which is rotatable between its locked and unlocked conditions, and the cam element of the lock is provided by an extending tumbler which rotates with the actuation of the lock between its locked and unlocked conditions.

4. A lockable switch means for an electric cord comprising a housing, a switch having "on" and "off" positions retained within the housing and having a control means operative from outside of the housing for moving the switch between its "on" and "off" positions, a lock having locked and unlocked conditions contained within the housing for being key-actuated between locked and unlocked conditions from outside the housing, terminal means provided within the housing for electrically engaging and connecting with the switch an electrical cord received within the housing for opening and closing a circuit therethrough by actuation of the switch, and interengagement means actuated by the lock for engaging the switch and locking the switch against movement when the lock is in its locked condition and disengaging and unlocking the switch when the lock is in its unlocked condition; the switch being a toggle switch with a control lever pivotable between a first "on" position and second "off" position and the interengagement means engages and disengages the lever for locking and unlocking the switch; the lock includes a movable cam element which actuates the interengagement means for engaging and disengaging the lever of the switch; the lock is a cylindrical lock which is rotatable between its locked and unlocked conditions and the cam element of the lock is provided by an extending tumbler which rotates with the actuation of the lock between its locked and unlocked conditions; and the interengaging means comprises a pin having a head which is engagable by the cam of the lock and an end which is movable toward and away from the lever of the switch for engaging and disengaging the lever for locking and unlocking the switch.

5. The switch means of claim 4 in which the cam of the lock has a surface for engaging the head of the pin, the interengaging means includes spring means urging the head of the pin toward and into contact with the surface of the cam, and the surface of the cam moves the pin in the direction toward the lock for engaging its lever as the lock is rotated from its unlocked condition toward its locked condition while the spring means moves the pin in the direction away from the switch for disengaging the lever when the lock is rotated toward its unlocked condition.

6. The switch means of claim 5 in which the lever of the switch has a top surface engagable externally of the housing for actuating the switch and a bottom surface, the bottom surface of the lever is engaged by the end of the pin when the switch is in its "off" position for locking the lever against movement when the lock is in its locked condition, and the pin is prevented by the lever from moving to its engaged position when the switch is in its "on" condition.

7. The switch means of claim 5 in which the housing has an elongated oval configuration with first and second ends each providing an opening for receiving therethrough the electric cord which is to have its circuit opened and closed.

8. The switch means of claim 7 in which the housing comprises first and second mating halves which are separable for having the cord received therethrough and connected with the terminal means and have interlocking means for permanently securing the halves together.

9. The switch means of claim 8 in which the interlocking means is provided by the first half of the housing having at least one projecting portion and the second half having a receptacle for receiving and retaining the projecting portion of the first half for permanently securing together the halves of the housing.

* * * * *